United States Patent [19]

Stoltefuss

[11] 4,248,481

[45] Feb. 3, 1981

[54] TUNNEL DRIVING APPARATUS WITH CUTTER ARMS INTERNAL AND EXTERNAL OF SUPPORT TUBE

[75] Inventor: Wilhelm Stoltefuss, Kamen, Fed. Rep. of Germany

[73] Assignee: Gewerkschaft Eisenhütte Westfalia, Lünen, Fed. Rep. of Germany

[21] Appl. No.: 65,948

[22] Filed: Aug. 13, 1979

[30] Foreign Application Priority Data

Aug. 18, 1978 [DE] Fed. Rep. of Germany ..... 2836131

[51] Int. Cl.[3] ..... E21D 9/08

[52] U.S. Cl. ..... 299/33; 299/61; 299/71

[58] Field of Search ..... 299/11, 33, 61, 67, 299/71

[56] References Cited

U.S. PATENT DOCUMENTS

| | | | |
|---|---|---|---|
| 3,469,884 | 9/1969 | Kampf-Emden | 299/33 |
| 4,077,670 | 3/1978 | Spies et al. | 299/33 X |
| 4,134,620 | 1/1979 | Valantin | 299/33 |
| 4,136,910 | 1/1979 | Plummer | 299/33 |
| 4,185,873 | 1/1980 | Bohnes et al. | 299/61 X |

FOREIGN PATENT DOCUMENTS

| | | | |
|---|---|---|---|
| 2462542 | 9/1977 | Fed. Rep. of Germany | 299/33 |
| 617593 | 7/1978 | U.S.S.R. | 299/33 |

*Primary Examiner*—Ernest R. Purser

*Attorney, Agent, or Firm*—Thompson, Birch, Gauthier, & Samuels

[57] ABSTRACT

Tunnel driving apparatus employs a hollow support tube positioned axially centrally inside a drive shield. An inner cutting machine is supported and positioned inside the support tube and serves to cut away a central region of a working face. Outer cutting machines are also supported by the support tube but on the exterior thereof. The outer cutting machines serve to cut away the outer region of the working face. The cutting machines may each have a pivotable arm carrying cutting drums and are supported and guided for axial and rotary motion relative to the support tube.

17 Claims, 2 Drawing Figures

TUNNEL DRIVING APPARATUS WITH CUTTER ARMS INTERNAL AND EXTERNAL OF SUPPORT TUBE

BACKGROUND OF THE INVENTION

The present invention relates to apparatus for driving tunnels, galleries, adits, roadways or other underground excavations, all collectively referred to, for convenience, as "tunnels."

It is known to utilize tunnel driving apparatus which has a shield supporting the forward region of the tunnel wall and protecting a cutting machine which cuts away the full cross-section of the tunnel from a working face. Examples of such known types of apparatus are described in German Pat. Nos. 1534602 and 1279053. Where tunnels of relatively large cross-section, say 8–12 meters in diameter, are to be driven, the cutting machine needs to be of large and robust construction in order to cut over the full working face. This gives rise to various problems, primarily with the guidance and support of the machine. To overcome this problem, a cutting machine just cutting over a central region of the working face can be used. Such apparatus is known from German Pat. No. 2437669. This known apparatus utilizes a cutting machine with a cutting arm or jib pivoted to a support which, in turn, is able to move about an axis coincident with the central tunnel axis. The cutting arm support is guided for advancement or retraction in the direction of the tunnel. Since the cutting machine is only designed to cut away part of the working face, it can be relatively small and of light construction so that the guidance and mounting thereof does not present difficulties. Where a tunnel of relatively large size is to be driven, it is necessary, however, to utilize several cutting machines each acting on part of the working face. Such an arrangement is known from German Pat. No. 2431652. With regard to the foregoing, there is a need for a versatile tunnel driving apparatus which is able to drive tunnels of large or small size with various cross-sectional shapes without excessive cost or complex construction. A general object of this invention is to provide such an improved form of tunnel driving apparatus.

SUMMARY OF THE INVENTION

In accordance with the invention, hollow support means, conveniently of cylindrical form, is positioned inside a shield of a tunnelling apparatus. A cutting appliance or machine which acts solely on the central region of the working face is located and supported interiorly within the support means. At least one further cutting appliance or machine which acts on the outer region of the working face is located and supported exteriorly on the support means. The support means can be rigidly connected, e.g., through struts, to the shield or, alternatively, adjustable bracing devices, e.g., hydraulic devices, can connect the support means to the shield. This latter expedient is useful in allowing the support means to adopt an eccentric position in the shield to more readily control the direction of tunnel advancement. In order to cut away the outer region of the working face, the further cutting appliance is mounted for rotation or part rotation relative to the support means. Where relatively large tunnels are to be driven, it is, however, preferable to utilize several cutting appliances, each mounted exteriorly on the support means to cut away collectively the outer region of the working face. With apparatus constructed in accordance with the invention, it is possible to cut out any desired profile from the working face quite accurately.

A variety of different cutting appliances can be used to cut away the central region of the working face, but it may be preferred to utilize an appliance with an arm or jib carrying drum-like rotary cutting means. The cutting arm can then be supported for pivoting up and down in an eccentric or offset position to the central tunnel axis and the cutting arm can be supported indirectly for motion about the central tunnel axis. Furthermore, the arm can be supported for advancement or retraction relative to the support means. In this way, the central region of the working face can be cut away by a series of concentric circular cutting paths. A cutting appliance suitable for this purpose is described in German patent specification No. 2437669.

The, or each, further or outer cutting appliance can be keyed or otherwise located to the support means for movement thereabout. One convenient guidance and support system utilizes a bearing ring surrounding the support means and movable, e.g., slidable, in the direction of the central tunnel axis or reverse. The, or each, outer cutting appliance may then also utilize a pivotable cutting arm linked to a support located with the bearing ring for movement about the support means. Two outer cutting appliances can be adopted and where the support means is cylindrical or otherwise symmetrical relative to the tunnel axis these appliances may adopt diametrically-opposed positions. Conveniently, the supports for the cutting arms of these outer appliances mount drive pinions meshing with a toothed ring or rim surrounding the support means, so that the appliances can be selectively driven around the latter to excavate the full outer region of the face, say in concentric cutting paths. Where more than two outer appliances are installed, each may be made to move only partially around the support means.

For ease of standardization and simplification, all the cutting arms and cutting means may be of identical design and by adding or removing at least the arms of the outer cutting appliances, the apparatus can cope with a variety of applications and different sized tunnels.

The invention may be understood more readily and various other aspects and features of the invention may become apparent, from consideration of the following description.

BRIEF DESCRIPTION OF DRAWINGS

An embodiment of the invention will now be described, by way of example, with reference to the accompanying drawings, wherein.

DESCRIPTION OF PREFERRED EMBODIMENT

Figure 1:
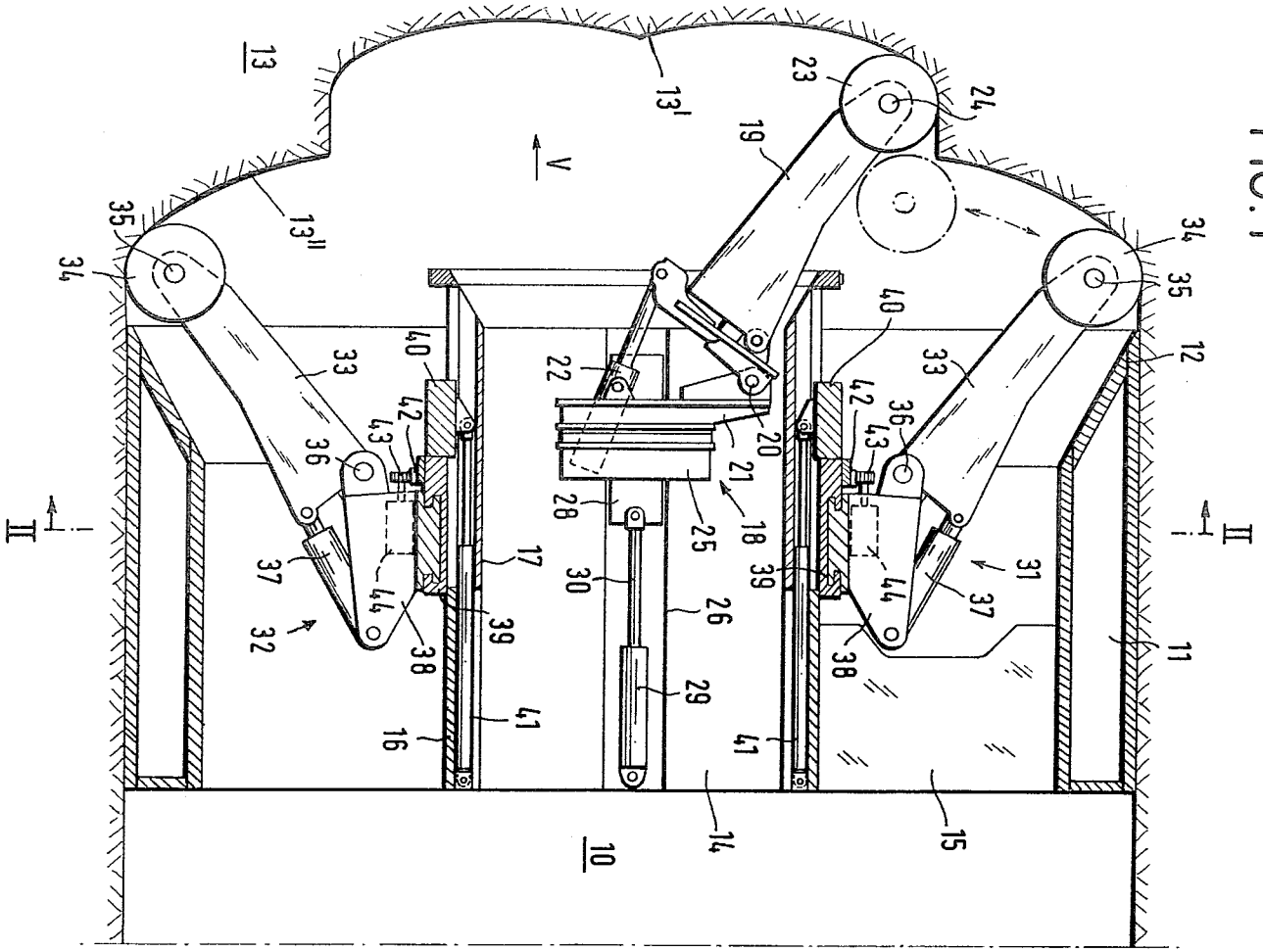
FIG. 1 is a sectional side view of apparatus made in accordance with the invention.

The apparatus depicted in the drawings serves to drive a tunnel, gallery, roadway or other underground opening or excavation and, for convenience, is referred to simply as a tunnel 10. In the drawing, the tunnel 10 is shown as being formed with a circular profile. The apparatus employs a shield 11 contacting and supporting the tunnel wall. The shield 11 is a hollow double-walled structure provided with a cutting edge 12. As is known, the shield 11 is advanced from time to time (arrow V, FIG. 1) as the driving progresses and preferably hydraulic rams (not shown) serve to advance the shield 11. The advancing rams can be supported on a rear tunnel support or lining (not shown) introduced to the rear of the apparatus as the driving progresses. Although the shield 11 is depicted as a singular structure, it could be one section of a multi-sectioned shield composed of shield sections axially spaced apart one behind another. In the case of small excavations, e.g., for service pipe lines, the shield 11 could be advanced by the progressively-extended pipeline, which is lengthened by adding individual pipe sections and driven forwardly by means of a fixed drive station at one end, as known per se.

Within the shield 11, there is provided support means 14, conveniently in the form of a tube or cylindrical body with inner and outer walls 16,17. The support means or body 14 has an external diameter considerably smaller than the inner diameter of the shield 11. The support means 14 is arranged coaxially with the shield 11 and the common axis of the shield 11 and support means 14 coincides with the axis of the tunnel 10. The support means 14 is rigidly fixed to the shield 11 with the aid of radial struts 15. Some three to six struts 15 can be employed and spaced regularly around the axis of the shield 11.

Figure 2:
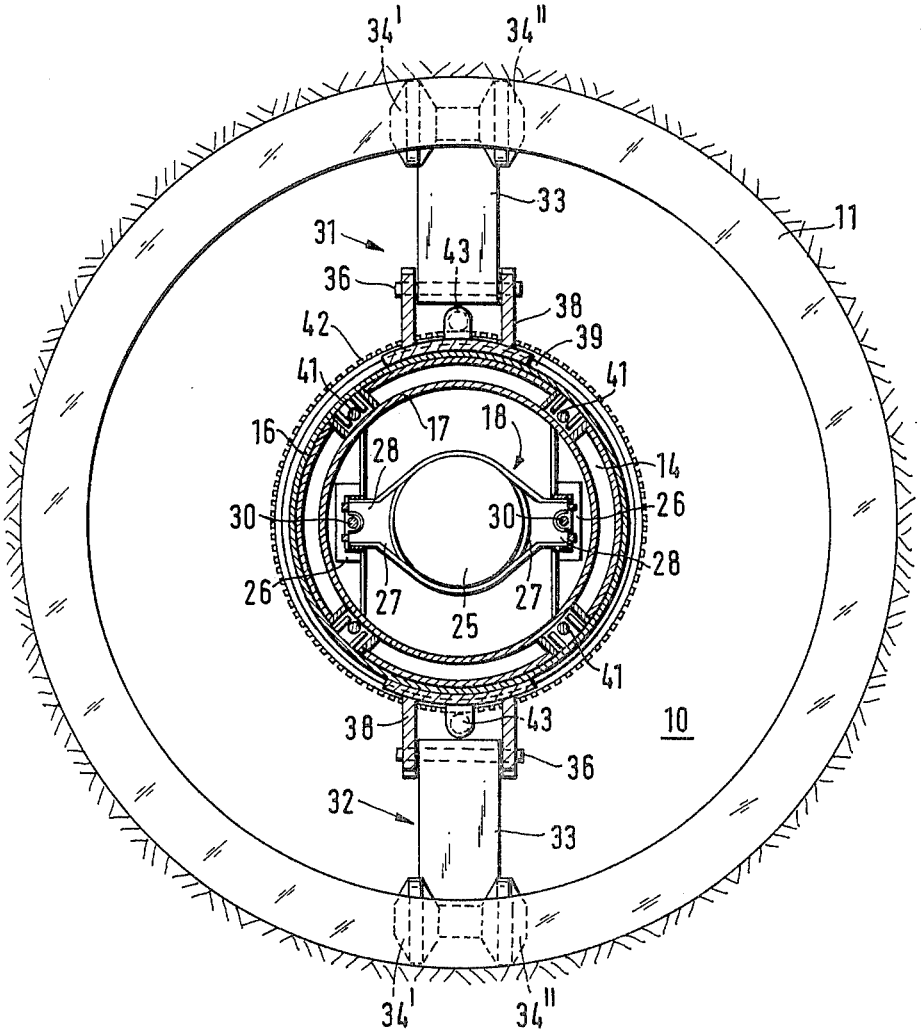
FIG. 2 is a sectional end view of the apparatus, the view being taken along the line II—II of FIG. 1.

A cutting appliance 18 is disposed partly within the support means 14. This cutting apparatus 18 corresponds to that described in German Pat. No. 2437669, which is herein incorporated by reference. The appliance 18 has an arm of jib 19 which can be swung up and down about a pivot joint 20 by actuating a piston and cylinder unit 22. The pivot joint 20 is spaced radially from the axis of the support means 14. The pivot joint 20 and the unit 22 are located on a support 21. Cutting means 23 is provided at the free end of the arm 19. The cutting means 23 preferably takes the form of two cutting drums or cylinders which carry cutting tools and which rotate about a common axis 24 perpendicular to the longitudinal axis of the arm 19. The cutting drums may have a frusto-conical shape, as described in the aforementioned German Pat. No. 2437665, to produce a smooth stepless cutting action. The arm 19 is hollow and the necessary drive for the cutting means 23 is transmitted through the arm 19. The cutting arm support 21 is, e.g., journalled on a bearing member 25 for rotation about the central axis of the support means 14. The bearing member 25 accommodates an actuator, conveniently hydraulically powered (not shown) which is effective to swivel the cutting arm support 21 about the bearing member 25. Guide rails 26, conveniently of U-shaped cross-section, are fixed to the inner wall 17 of the support means 14 at diametrically-opposed positions to lie in a substantially horizontal plane containing the longitudinal axis of the support means 14. The bearing member 25 has two laterally-projecting portions 27 carrying guide blocks 28, which are received in the guide rails 26. The entire appliance 18 can thus be displaced inwardly or outwardly of the support means 14 and is guided by the blocks 28 engaged in the rails 26. To effect this displacement of the appliance 18, use is made of two hydraulic rams 29 with cylinders attached to the support means 14 or to the guide rails 26 and having piston rods 30 connected to the guide blocks 28. The cutting arm 19 can thus be thrust forwards or retracted by the rams 29, swung up and down by the unit 22 and canted or rotated to bring the axis 24 through any angle by the actuator associated with the bearing member 25. These controls enable the cutting means 23 to work on the face 13 to be removed over a central region denoted 13'. Concentric cuts can be made in the face 13 by the cutting means 23 to excavate a circular walled region 13' larger than the outer diameter of the support means 14 but smaller than the desired overall size of the tunnel 10. The outer zone 13" of the working face 13 are removed with the aid of additional cutting appliances 31,32 of substantially identical construction. Each appliance 31,32 employs a cutting arm 33 similar to the cutting arm 19 of the appliance 18. The arm 33 of each appliance 31,32 carries a cutting means 34, which again takes the form of a pair of frusto-conical drums 34' 34" (FIG. 2), which rotate about an axis perpendicular to the longitudinal axis of the arm 33. The arm 33 of each appliance 31,32 is pivotably connected with a pivot joint 36 to a cutting arm support 38 and a piston and cylinder unit 37 serves to swing the arm 33 about the joint 36. The cutting arm support 38 of each appliance 31,32 is located, e.g., keyed, for movement on a common bearing ring 39 mounted on the exterior of the outer wall 16 of the support means 14. Thus, each support 38 can be moved about the central longitudinal axis of the support means 14. The bearing ring 39 is also displaceable in a direction parallel to the central axis of the support means 14. For this purpose, the bearing ring 39 is attached to a slide piece 40 of integral or multi-part construction. The slide piece 40 is engaged and supported in a cut-out in the outer wall 16 of the support means 14. Hydraulic rams 41 are arranged in the space between the inner and outer walls 16,17 of the support means 14 and engage with the slide piece 40. By operating the rams 41, the slide piece 40, and hence the bearing ring 39 with the supports 38, can be advanced or retracted with respect to the support means 14. The bearing ring 39 has a toothed rim 42 integral or separate therefrom. The supports 38 carry drive pinions 43 meshing with the rim 42. The supports 38 have drive means 44, which rotate the pinions 43. Thereby, the supports 38 can be moved around the ring 39 to bring the appliances 31,32 into any desired position. During operation, the appliance 18 works as previously described to cut away the central region 13' and, conveniently, the cutting arm 19 is moved in concentric circles. The outer zone 13" of the face 13 is cut away by the appliances 31,32 and their cutting arms 33 can likewise move individually or collectively in concentric circles. The cutting arm supports 38 can be moved in unison to maintain the appliances 31,32 is diametrically opposed positions and this tends to equalize the reaction forces on the support means 14.

The operation of the appliances 18,31,32 can be controlled to distribute the cutting work. Once the face 13 has been cut away to a pre-determined extent to the full cross-section of the tunnel, the appliances 18,31,32 can be retracted and the shield 11 can be advanced ready for the next working cycle. The region of the tunnel immediately behind the shield 11 would be supported by tubbings or other components designed to provide a permanent tunnel lining, as is known. It may be advisable to provide a dust screen in the shield 11 behind the cutting appliances. It is also possible to utilize hermetic seals to permit the appliances to work under low pressure which tends to restrict the dust from passing to the rear of the tunnel.

Where excavations of relatively small cross-section are to be driven, it is possible to remove the outer appliances 31,32 or the cutting arms 33 thereof, and to use the appliance 18 solely to cut away the face 13. It is also possible to utilize one outer appliance 31,32 instead of two and this single appliance would then have to be moved entirely around the bearing ring 39 to work the entire outer zone 13''. Where excavations of especially large cross-section are to be driven or otherwise, it may be desirable to employ more than two outer appliances 31,32 and to make each appliance rotate fully about the bearing ring 39.

In a further modification of the invention, the inner cutting appliance 18 is replaced by other forms of cutting devices, such as a drill head or other device which rotates about the axis of the support means 14 to cut away the central region 13'. This modification may be most useful where the terrain in which the tunnel is being driven changes according to geological conditions so that the work needed to be done by the appliances 18,31,32 changes. The central region 13' may thus be reduced to a size commensurate with that achieved by a rotary drill head producing a pilot hole which the outer appliances can easily enlarge by working radially inwards. In this case, it may be desirable to increase the number of outer appliances from two as illustrated.

It is also possible to modify the support means 14. For example it may be desired to produce a tunnel of non-circular cross-section and the shape of the support means 14 can be varied from that depicted. Instead of employing rigid struts to connect the support means 14 to the shield 11, other connection devices can be employed permitting the support means 14 to be adjusted radially and/or axially. This may be accomplished by hydraulic devices enabling the support means 14 to be re-positioned at will and this is a useful measure for controlling the direction in which the tunnel is driven. It is also possible to provide not only for the adjustment of the support means 14 but also for its bracing with, for example, hydraulic means.

I claim:

1. In a shield-type tunnelling apparatus having a shield containing a hollow support means with a first cutting appliance equipped with a first cutting means for removing material from a first working face, said first cutting appliance being mounted and supported interiorly of said support means, the improvement comprising:

said support means having a tubular configuration; said first cutting appliance being provided with a pivotal first arm movably carrying said first cutting means for effecting removal of material from a central region of the working face; and at least a second cutting appliance mounted by bearing means arranged externally on said support means to permit said second cutting appliance to move around said support means, said second cutting appliance having a pivotal second arm movably carrying a second cutting means for effecting removal of material from an outer region of the working face.

2. Apparatus according to claim 1 and further comprising means for driving the cutting means of the cutting appliances, means for swinging the pivotal arms of the cutting appliances and means for moving the cutting appliances along the support means towards the working face.

3. Apparatus according to claim 1, wherein said bearing means mounts said second cutting appliance for rotation about the support means.

4. Apparatus according to claim 1, wherein the first cutting appliance further comprises a support with a pivot joint for the arm of the first cutting appliance, the arm support being mounted to the support means to enable the longitudinal axis of the arm to be moved around the central axis of the tunnel.

5. Apparatus according to claim 4, wherein the arm support is rotatably mounted to a bearing member supported within the support means.

6. Apparatus according to claim 5, wherein the bearing member is slidable relative to the support means for advancement or retraction relative thereto.

7. Apparatus according to claim 6; and further comprising means for swinging the arm of the first cutting appliance about the pivot joint, means for rotating the arm support about the bearing member and means for effecting advancement or retraction of the bearing member.

8. Apparatus according to claim 1, wherein the first cutting appliance is supported within the support means for advancement or retraction relative thereto.

9. Apparatus according to claim 1, wherein the first cutting means is rotatable about an axis extending transversally to the longitudinal axis of the first arm, the first arm is pivotably connected to an arm support in a position offset eccentrically from the central axis of the tunnel, the arm support is mounted to a bearing member for rotation about an axis coincident with the central axis of the tunnel and the bearing member engages in slidable manner with guide means disposed within the support means for movement along the support means.

10. Apparatus according to claim 1, and further comprising a further cutting appliance supported by said support means exteriorly thereof to assist the second cutting appliance in cutting away the outer region of the working face.

11. Apparatus according to claim 10, wherein the second and further cutting appliances are both supported by said bearing means for rotation about the support means.

12. Apparatus according to claim 1, wherein the bearing means for the second cutting appliance is also movable in the tunnel driving direction in relation to the support means.

13. Apparatus according to claim 1, wherein the second cutting appliance is also movable in the tunnel driving direction in relation to the support means.

14. Apparatus according to claim 1, wherein the bearing means is displaceable axially of the support means to advance or retract the second cutting appliance.

15. Apparatus according to claim 1, wherein the bearing means has a toothed rim or the like and a drive pinion of the second cutting appliance meshes with the toothed rim and effects movement of the appliance about the support means.

16. Apparatus according to claim 1, wherein the second cutting means is rotatable about an axis extending transversally of the second arm and a support to which the arm is pivotably connected, wherein the arm support is connected to the bearing means for rendering the second cutting appliance movable in relation to the support means in at least two directions.

17. Tunnel driving apparatus comprising a shield, a tubular body constituting machine support means disposed within said shield, a first cutting machine with a pivotable jib carrying cutting means, a support mounting a pivot joint for the jib of the first cutting machine, means for pivoting the jib of the first cutting machine relative to the support, a bearing mounting the support for rotation about the axis of the tubular body, means for effecting rotation of said support, guide means guiding the bearing for movement within the tubular body and parallel to the axis of the tubular body, means for displacing the bearing and hence the first cutting machine relative to the guide means, further cutting machines each with a pivotable jib carrying cutting means, a support mounting a pivot joint for the jib of each further machine, means for pivoting the jib of each further cutting machine relative to its associated support, a bearing ring external to the tubular body locating the support of each further machine for rotation about the tubular body, means for effecting rotation of the supports of each further machine and means for displacing the bearing ring and hence the further cutting machines in a direction parallel to the axis of the tubular body.

* * * * *